US008657153B2

(12) United States Patent
Hatter et al.

(10) Patent No.: US 8,657,153 B2
(45) Date of Patent: Feb. 25, 2014

(54) INNER WIPES

(76) Inventors: Donald Hatter, Lincroft, NJ (US); Lawrence Lambelet, Flemington, NJ (US)

( * ) Notice: Subject to any disclaimer, the term of this patent is extended or adjusted under 35 U.S.C. 154(b) by 270 days.

(21) Appl. No.: 12/898,257

(22) Filed: Oct. 5, 2010

(65) Prior Publication Data

US 2011/0284570 A1 Nov. 24, 2011

Related U.S. Application Data

(63) Continuation-in-part of application No. 12/784,801, filed on May 21, 2010.

(51) Int. Cl.

| | |
|---|---|
| ***A47K 10/24*** | (2006.01) |
| ***B65H 35/04*** | (2006.01) |
| ***A47K 10/38*** | (2006.01) |

(52) U.S. Cl.
USPC ..... 221/63; 221/45; 221/92

(58) Field of Classification Search
USPC ..... 221/24, 26, 33, 36, 45, 46, 63, 302, 221/303, 306
See application file for complete search history.

(56) References Cited

U.S. PATENT DOCUMENTS

| | | | | |
|---|---|---|---|---|
| 2,555,205 | A | 5/1951 | Steffens | |
| 3,380,621 | A * | 4/1968 | Rissberger, Jr. et al. | 220/203.1 |
| 3,848,822 | A * | 11/1974 | Boone | 242/590 |
| 3,987,930 | A * | 10/1976 | Fuson | 220/287 |
| 4,228,633 | A * | 10/1980 | Corbic | 53/412 |
| 5,135,134 | A | 8/1992 | Dancy | |
| 5,509,593 | A | 4/1996 | Bloch | |
| 5,950,960 | A | 9/1999 | Marino | |
| 6,503,326 | B1 | 1/2003 | Mikelionis | |
| 6,899,250 | B2 | 5/2005 | FitzSimons | |
| 7,128,251 | B1 * | 10/2006 | Galle | 225/2 |
| 7,311,221 | B2 | 12/2007 | Serfaty | |
| 7,354,598 | B2 | 4/2008 | Masting | |
| 7,731,057 | B2 | 6/2010 | Evans | |
| 2004/0108324 | A1 | 6/2004 | Holland | |
| 2004/0120988 | A1 * | 6/2004 | Masting | 424/443 |
| 2005/0035134 | A1 * | 2/2005 | Gamoff et al. | 221/37 |
| 2005/0247720 | A1 | 11/2005 | FitzSimons | |
| 2005/0279757 | A1 | 12/2005 | Bitowft | |
| 2007/0210098 | A1 | 9/2007 | Evans | |
| 2007/0215632 | A1 | 9/2007 | Bendor | |
| 2009/0065518 | A1 * | 3/2009 | Carnevali | 220/711 |
| 2009/0194555 | A1 | 8/2009 | Hoefing | |

(Continued)

FOREIGN PATENT DOCUMENTS

| | | | |
|---|---|---|---|
| DE | 3938352 | A1 | 7/1990 |
| EP | 1875839 | A1 | 1/2008 |
| GB | 2394219 | A | 4/2004 |
| WO | 2005005285 | A1 | 1/2005 |

*Primary Examiner* — Gene Crawford
*Assistant Examiner* — Kelvin L Randall, Jr.
(74) *Attorney, Agent, or Firm* — Lawrence Lambelet

(57) ABSTRACT

The present invention provides a dispenser for moisturized sheets in the core of a toilet paper roll. Not only are wet and dry wipes provided coincidentally, the location is particularly handy for toilet use. In a utilization of existing bathroom fixtures, the novel concept offsets the rotational axis of the toilet paper roll to make an aperture available to dispense the moisturized sheets from the volume of the core previously occupied by the conventional spool. The invention further provides a hermetically sealed refill unit, a mechanism for singlating individual wipes, and means for preventing moisture loss from the sheets.

17 Claims, 8 Drawing Sheets

(56) References Cited

U.S. PATENT DOCUMENTS

2010/0078443 A1 4/2010 Hoefing
2010/0133287 A1 6/2010 Tramontina
2010/0187250 A1 7/2010 Kryshak

* cited by examiner

INNER WIPES

CROSS-REFERENCE TO RELATED APPLICATIONS

This is a Continuation-In-Part Application claiming priority to U.S. patent application Ser. No. 12/784,801, filed May 21, 2010, which is incorporated herein by reference.

FIELD OF THE INVENTION

This invention relates to cleaning wipes, and more particularly to hygienic tissues for bathroom use.

BACKGROUND OF THE INVENTION

Towelettes, or wipes, find multiple uses in a bathroom or lavatory. In addition to housekeeping use, they can be used to cleanse or dry skin. Dry wipes are sometimes inadequate, however, when sensitive or stubbornly soiled skin is involved. Wet wipes are needed for this purpose but are rarely in a handy location, particularly when a need arises at the toilet. Wet wipes require container storage to protect against evaporative losses. The containers are generally placed on a surface remote from the handy wall location of the toilet tissue roll and may not be within reach for a person in need at the toilet.

The prior art lacks a comprehensive solution. In U.S. Pat. No. 6,503,326 to Mikelionis, two rolls, one dry and one wet, are placed side-by-side on the customary toilet roll spool. Each roll is folded so that it is half width, and presumably, half length as well. Because they share the same spool, dispensing one potentially moves the other synchronously. The biggest problem, however, is that the consumer is forced to buy specially-configured toilet tissue at a premium to the ubiquitous, and commodity-priced, toilet tissue roll.

U.S. Pat. No. 5,950,960 to Marino avoids synchronous movement by placing dry and wet rolls in two separate but connected containers. The containers are suspended in a conventional wall bracket above and below a toilet roll spool. While hinged covers give access to the rolls, continually lifting the covers can be a nuisance. Also, the containers take up space, which can be at a premium near a toilet. To further the inconvenience, the equipment involves an installation.

U.S. Pat. No. 3,848,822 to Boone teaches placement of a roll of wet tissues inside of a drum-like container located in the core of a toilet roll. The drum-like container replaces the conventional wall bracket spool. While this solution provides a handy location and a good utilization of space, there are several deficiencies. Boone does not teach a means for separating individual sheets. Also, the leading end of the tissue exposed through the slit-like opening in the end of the drum would act like a wick to dry out the moisture inside of the drum. Lastly, because the drum is immobilized, and because toilet roll cores are notoriously out-of-round, there is a risk that the toilet roll will bind on the drum while unwinding.

These shortcomings are addressed by the novel solutions of the present invention.

SUMMARY OF THE INVENTION

It is accordingly an object of the present invention to provide a convenient way to dispense wet wipes in a bathroom. It is a further object to make wet wipes available to a person seated on a toilet. It is a further object to combine the dispensing of wet wipes with that of ordinary dry toilet tissue. It is a further object to accomplish this in a way that does not involve a requirement to purchase specialty toilet tissue rolls.

It is a further object to utilize existing installations of toilet roll brackets without requiring modifications or new equipment. It is a further object to fully utilize the space in the core of a common toilet tissue roll for the purpose of dispensing the wet wipes. It is a further object to maintain a moisture barrier to prevent evaporative losses from a storage environment of the wet wipes. It is a further object to maximize the capacity inside the core of a mounted toilet tissue roll by eliminating the existing toilet roll spool. It is a further object to provide a means for singlating individual wet wipe sheets which are connected together to dispense sequentially. It is a further object to facilitate dispensing by providing a means to withdraw an end of the next sheet from the storage environment without prematurely exposing the sheet. It is further object to provide a convenient refill put-up to replenish the wet wipes. It is a further object to provide a means for unwinding the toilet roll from around a closely-fitting core insert without rotating the insert.

These objects, and others to become hereinafter apparent, are embodied in a toilet roll dispenser for moisturized sheets comprising a cylindrical dispenser, having a rotational axis, configured to fit within the core of a toilet roll. The toilet roll dispenser further comprises a plurality of moisturized sheets contained within the cylindrical dispenser, said moisturized sheets connected by perforations to dispense sequentially from, at least, one end of the core. The toilet roll dispenser further comprises a means for singlating individual sheets by initiating a tear at one of the perforations. The toilet roll dispenser further comprises a means for connecting the cylindrical dispenser to a wall bracket having two arms with recesses to receive a conventional toilet roll spool. With the toilet roll dispenser so configured, a roll of toilet paper rotatably mounted on the cylindrical dispenser and suspended within the wall bracket by the means for connecting can unwind conventionally about the rotational axis, while the moisturized sheets can dispense from the interior of the core.

In a preferred embodiment, the means for connecting comprises end caps placed at each end of the cylindrical dispenser. The end caps have bosses configured to fit the recesses and a means for articulating the bosses to removably and securely mount the cylindrical dispenser between the two arms of the wall bracket. At least one of the end caps comprises a dispensing aperture centered on the rotational axis in communication with the interior of the cylindrical dispenser. The bosses lie along an axis parallel to and offset from the rotational axis such that the dispensing aperture can be made accessible from below the wall bracket. The means for articulating each boss comprises a flexible beam with the boss positioned at a distal end thereof, a proximal end thereof anchored at the end cap, the beam positioning the boss to articulate into the recess by flexing the distal end.

In another aspect of the preferred embodiment, the means for singlating comprises a horn positioned in the aperture, the position such that a downward pull on an exposed sheet effectively forces the horn into the sheet and snags an elongated slit in the perforation. The snag initiates a tear which leaves the next sheet flush with the aperture after the exposed sheet is separated by tearing. The dispensing aperture can then be closed by a means for covering to prevent moisture loss from the interior of the cylindrical dispenser. In a particularly preferred embodiment, the means for covering is a snap-fit cap. In an alternative embodiment, the means for covering is a plug having a means for extracting the next sheet.

In another aspect of the preferred embodiment, the cylindrical dispenser comprises a hermetically-sealed refill unit having moisture vapor barrier protection. The refill unit is comprised of a closed end at one end of the cylindrical dispenser, an open end at the other end of the cylindrical dispenser, and a means for hermetically sealing the open end. In a particularly preferred embodiment, the means for hermetically sealing comprises a bonded foil membrane.

In another aspect of the preferred embodiment, the toilet roll dispenser comprises a means for unwinding the toilet roll without causing rotation of cylinder and consequence in twisting or displacement of the next sheet in the aperture. In a particularly preferred embodiment, the means for unwinding comprises at least two bearing rings rotating freely in circumscribing races near the ends of the cylinder, the rings configured to frictionally fit the core of the toilet roll and provide clearance for the cylinder.

As this is not intended to be an exhaustive recitation, other embodiments may be learned from practicing the invention or may otherwise become apparent to those skilled in the art.

DESCRIPTION OF THE DRAWINGS

Various other objects, features and attendant advantages of the present invention will become fully appreciated as the same becomes better understood through the accompanying drawings, in which like reference characters designate the same or similar parts throughout the several views, and wherein.

DETAILED DESCRIPTION OF THE PREFERRED EMBODIMENT

Figure 1:
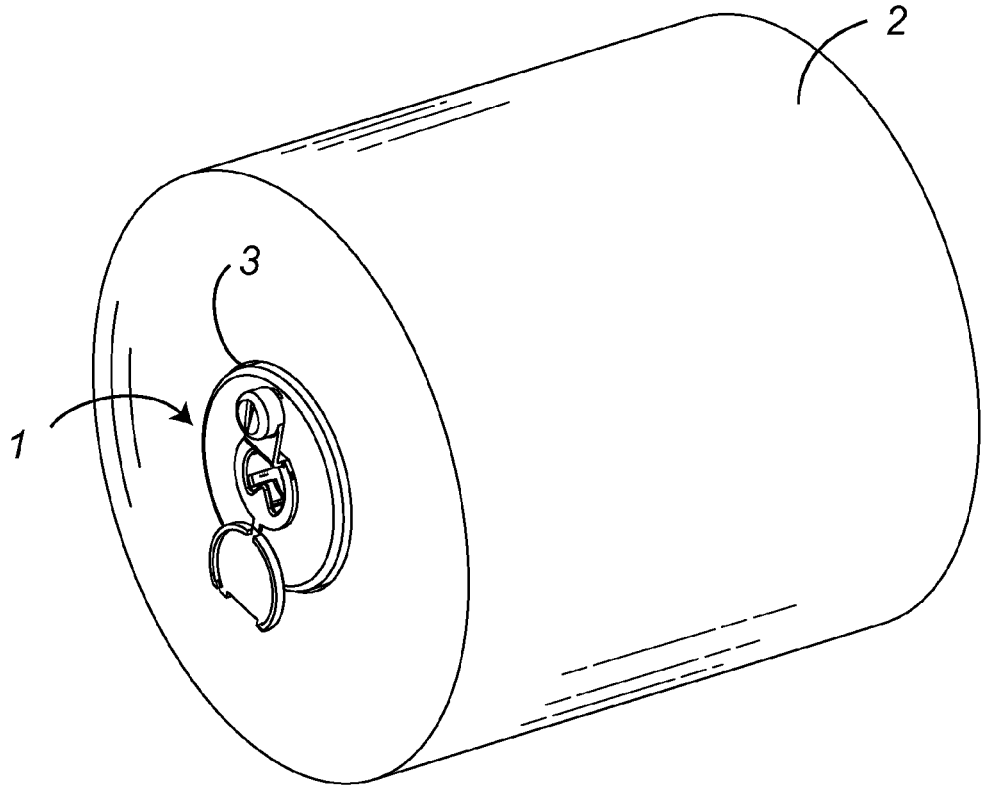
FIG. 1 is a perspective view of the toilet roll dispenser of the present invention with a roll of toilet paper disposed thereon.
Figure 2:
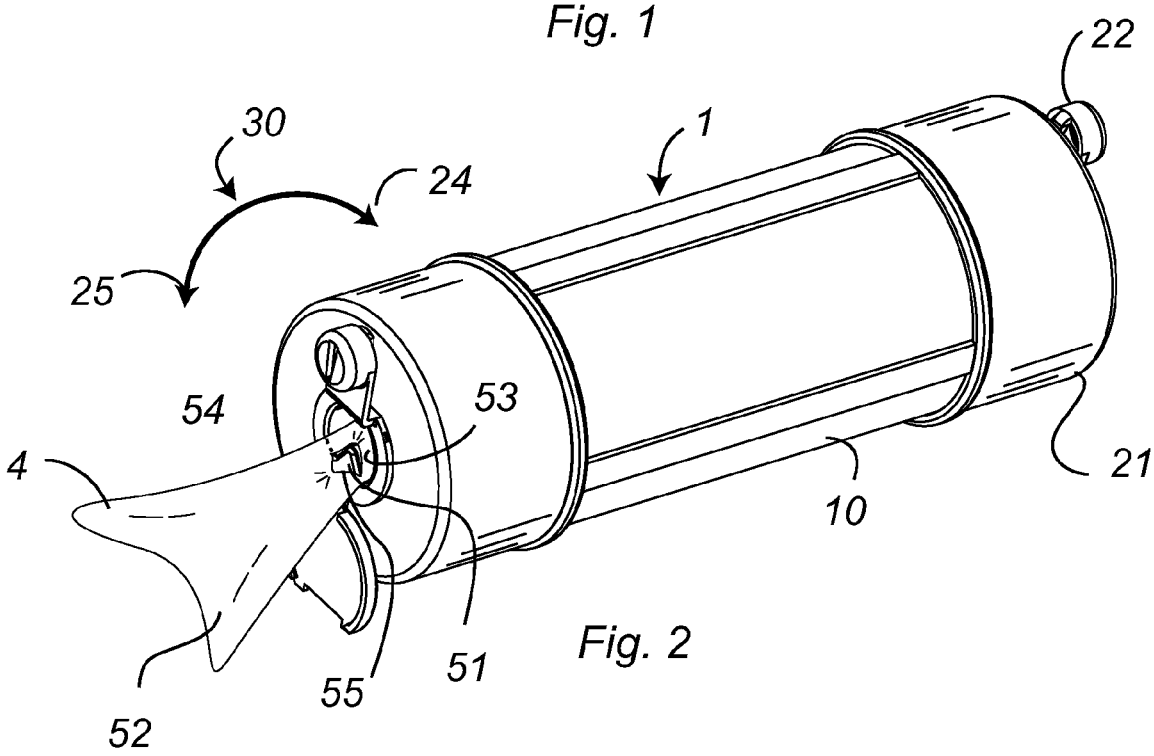
FIG. 2 is a perspective view of the toilet roll dispenser.
Figure 17:
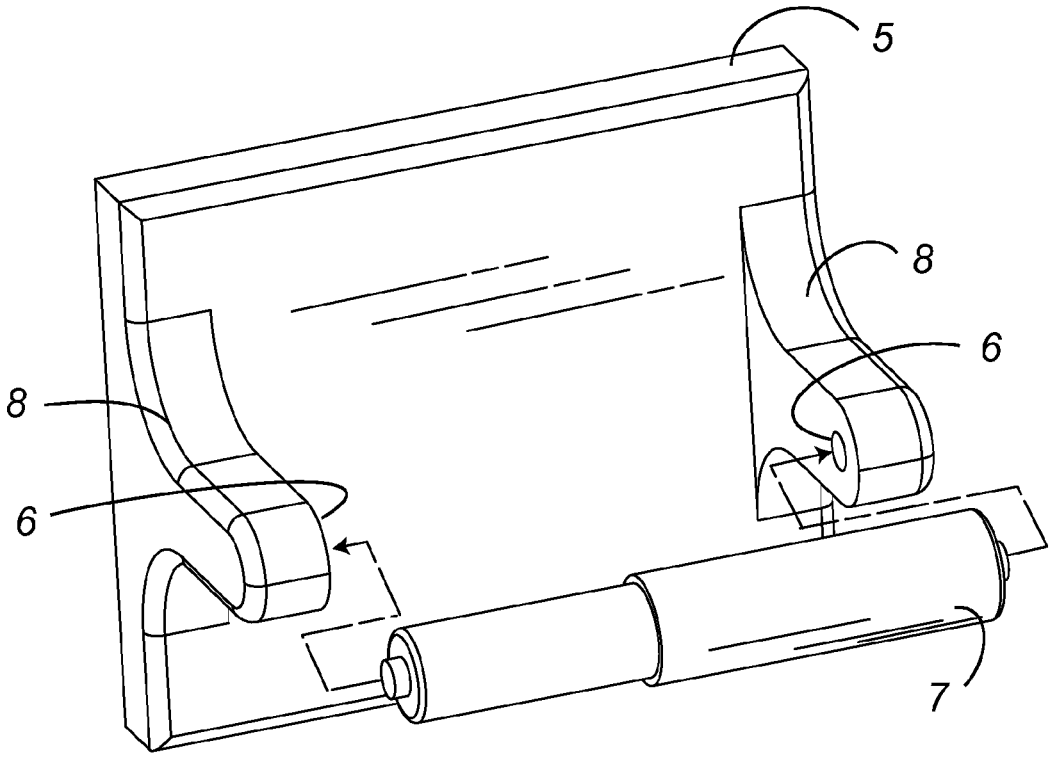
FIG. 17 is a perspective view of toilet roll wall bracket and spool.

As shown in FIGS. 1, 2 and 17, a toilet roll 2, wound around a core 3, is conventionally suspended in a wall bracket 5 by a spool 7 placed through the core and into recesses 6 of a pair of bracket arms 8. The toilet roll 2, thusly mounted in the wall bracket 5, can dispense sheets of toilet paper by unwinding from around the spool 7. In the present invention, the spool 7 is replaced by a toilet roll dispenser 1. The toilet roll dispenser 1 provides the additional capability of dispensing a plurality of moisturized sheets 4. The moisturized sheets 4 are conveniently located together with the dry sheets while both are close at hand for toilet use.

Figure 4:
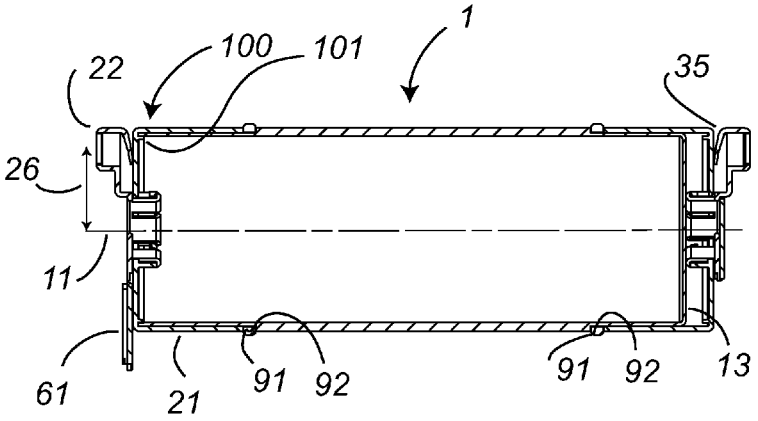
FIG. 4 is sectional view taken along the lines 4-4 of FIG. 3.
Figure 3:
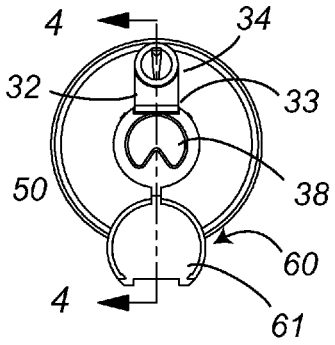
FIG. 3 is an end elevation view of the toilet roll dispenser showing an open aperture.
Figure 5:
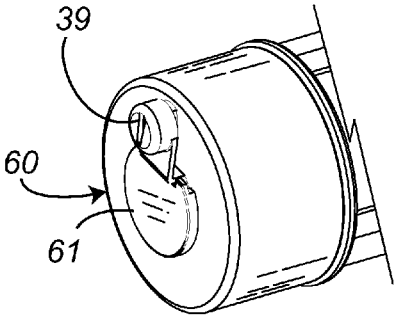
FIG. 5 is a partial perspective view of the toilet roll dispenser showing a closed aperture.

Referring to FIGS. 2-5 and 7, the toilet roll dispenser 1 is comprised of a cylindrical dispenser 10 and a means for connecting 20 the cylindrical dispenser 10 to the wall bracket 5. The cylindrical dispenser 10 provides a housing for the moisturized sheets 4, which are contained there within. The cylindrical dispenser 10 protects the moisturized sheets 4 from the evaporation of moisture there from. The cylindrical dispenser 10 is formed as a unitary container with a closed end 13 (FIG. 4). The other end, an open end 12 (FIG. 7), provides access for the moisturized sheets 4 and is the only aperture to the container requiring some form of sealing to complete the protective envelope. The container is comprised of a moisture-vapor barrier material. The cylindrical dispenser 10 has a rotational axis 11 about which the toilet roll 2 unwinds.

The means for connecting 20 is comprised of end caps 21 placed over each end of the cylindrical dispenser 10. Each end cap 21 has a boss 22 configured to fit within the recess 6 of the bracket arm 8. The bosses 22 lie along an axis parallel to, and offset from, the rotational axis 11. A preferred offset distance 26 (FIG. 4) is comparable that of the axis of core 3 to the axis of spool 7 when the toilet roll 2 is conventionally mounted. The reader is reminded that the diameter of the spool 7 is significantly less, typically, than the diameter of the core 3; consequently, the axis of the hanging roll is offset from that of the spool, and the preferred offset distance 26 permits access to the moisturized sheets 4 from below the bracket arms 8.

The end caps 21 are further comprised of a means for articulating 30 the bosses 22 to removably, and securely, mount the cylindrical dispenser 10 between the bracket arms 8 of the wall bracket 5. In the preferred embodiment, the means for articulating 30 is comprised of a flexible beam 32. The flexible beam 32 connects the boss 22 at a distal end 34 thereof to the end cap 21 at a proximal end 33 thereof. The flexible beam 32, supported from the proximal end 33, arcuately articulates (FIG. 2) the distal end 34 to move the boss 22 from a bypass position 24 to a seated position 25 in the recess 6. A close-tolerance fit of the end caps 21 on the ends of the cylindrical dispenser 10 forms a firm base for each flexible beam 32. The flexible beam 32 may provide a pre-load at the seated position 25 to bias the boss 22 in its engagement to the recess 6. Support spring 35 (FIG. 4) may also be added to further stiffen the flexible beam 32. In a preferred embodiment, support spring 35 is tapered in both thickness and side cut to provide a graduated response to deflection of the beam.

The moisturized sheets 4 are connected by lines of perforations 54 to form a continuous web, which takes up a compact configuration inside the cylindrical dispenser 10. The compact configuration may be a roll, from which the web is pulled inside out, or may otherwise be a non-entangling coil. At least one end cap 21 is provided with a dispensing aperture 38 through which the moisturized sheets 4 are dispensed from the open end 12 of the cylindrical dispenser 10. The dispensing aperture 38 is aligned with the rotational axis 11 to centrally dispense the moisturized sheets 4. The dispensing aperture 38 is comprised of a means for slinglating 50 an exposed sheet 52 from a next sheet 53. In the preferred embodiment, the means for singlating 50 comprises a horn 51. The horn 51 is placed in the throat of the dispensing aperture 38 and is configured to snag one of the perforations of the passing web. As an exposed sheet 52 is pulled down over the horn 51, a tapered end 56 is insinuated into the folded conformation of the exposed sheet 52 and penetrates one of the perforation slits to nucleate, thereby, a tear. In a preferred embodiment, at least one of the perforation slits is a centrally-disposed elongated slit 55. The elongated slit 55 facilitates the penetration of the tapered end 56 while not appreciably weakening the tensile strength of the web. The tapered end 56 may be smoothly chamfered to avoid undue abrasion of the exposed sheet 52.

If the next sheet 53 is prematurely exposed, it would act like a wick to evacuate moisture from the interior of the cylindrical dispenser 10. Instead, the next sheet 53 preferably remains in the throat of dispensing aperture 38, where it is positioned to be drawn out in sequence as exposed sheet 52, and where it is prevented from interfering with a means for covering 60 the dispensing aperture 38. The means for covering 60 provides a means for preventing moisture loss 100 by sealing the containerized environment of the moisturized sheets 4. The means for preventing moisture loss 100 additionally comprises a luer taper 101. The luer taper 101 forms a seal between the end cap 21 and the open end 12 by removably force-fitting the open end 12 into the luer taper 101. In the preferred embodiment, the means for covering 60 comprises a removable snap-fit cap 61, as shown in both open and closed positions in FIGS. 3-5. Snap-cap 61 is retained in a closed position by snapping together interconnecting lugs 62.

Figure 7:
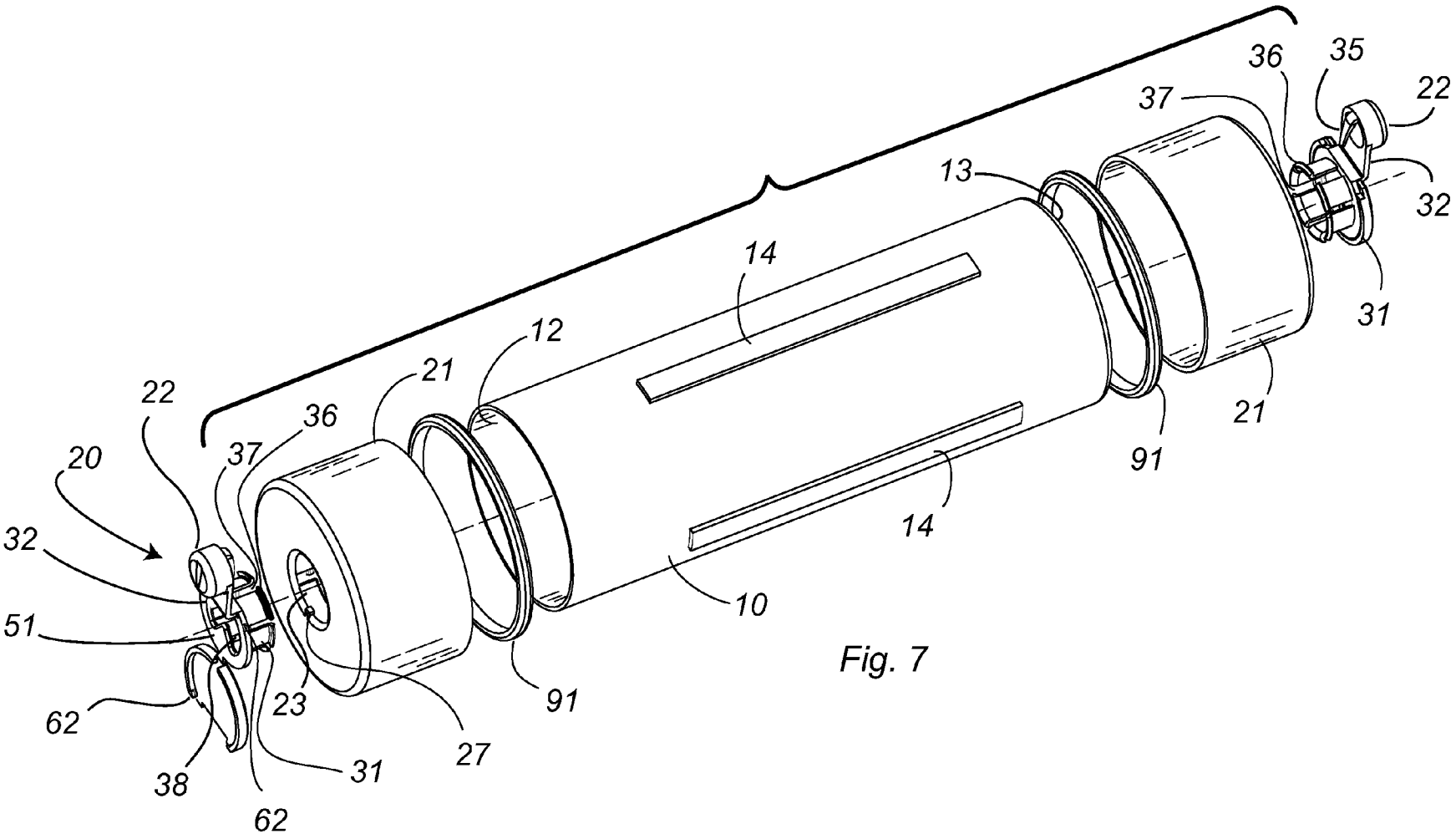
FIG. 7 is an exploded perspective view of the toilet roll dispenser.
Figure 8:
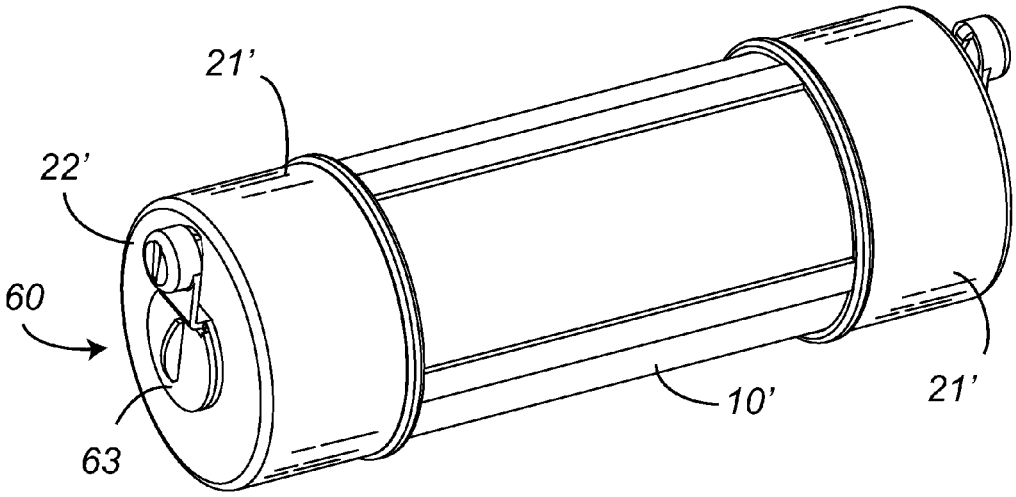
FIG. 8 is a perspective view of an alternative embodiment of the toilet roll dispenser.
Figure 10:
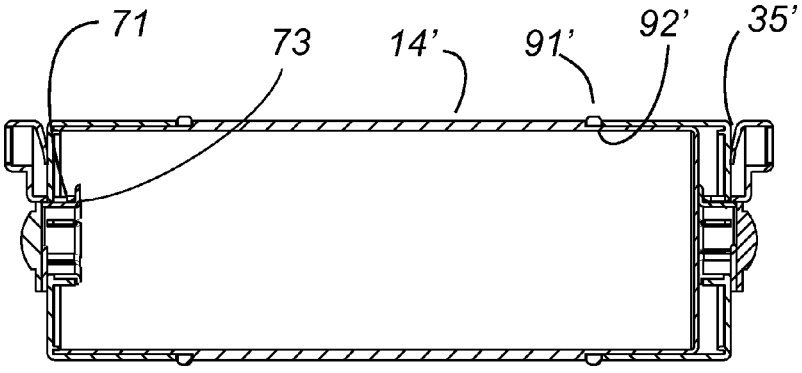
FIG. 10 is a sectional view taken along the lines 10-10 of FIG. 9.
Figure 9:
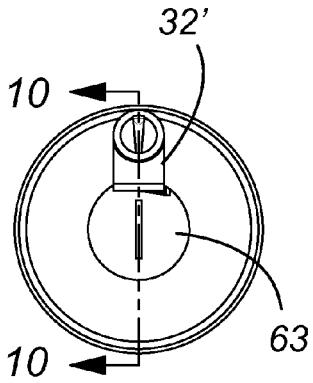
FIG. 9 is an end elevation view of the alternative embodiment.
Figure 11:
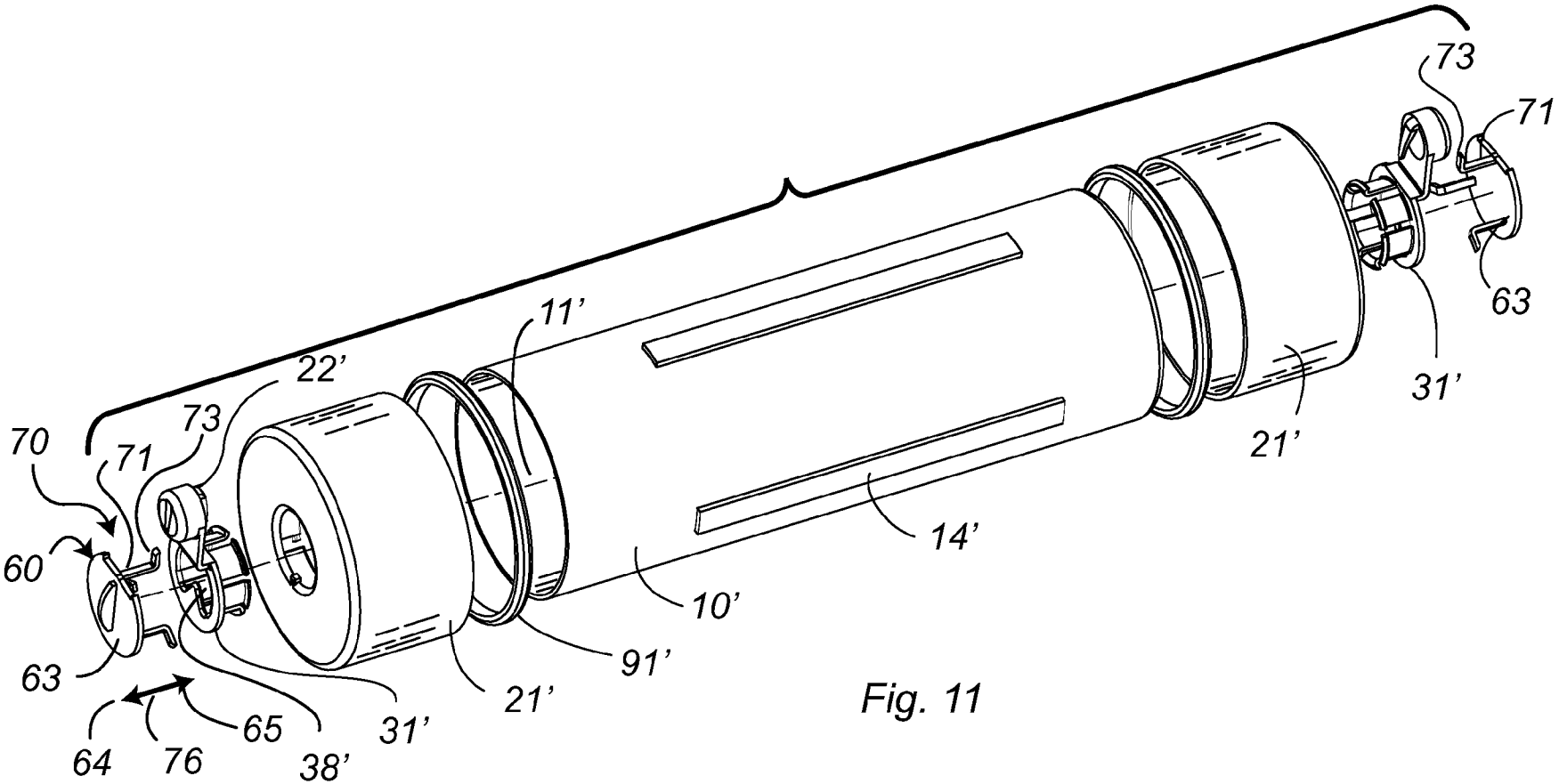
FIG. 11 is an exploded perspective view of the alternative embodiment.

In the preferred embodiment, the flexible beam 32, the dispensing aperture 38, the horn 51 and the snap-fit cap 55 are formed as a part of an end-cap insert 31. The end-cap insert 31 provides a means to avoid undercuts in the molding of these features while simplifying some assembly steps. Tooling access port 39 (FIG. 5) additionally allows the support spring 35 to be molded without an undercut. The end-cap insert 31 can be fitted to an annual aperture 23 in the end cap 21, as best shown in FIG. 7. The end-cap insert 31 is secured to the end cap 21 by a ring of ledges 36. The ring of ledges 36 can be resiliently compressed by means of slots 37 to narrow the ring diameter so as to pass through the annular aperture 23. The ring of ledges 36, once passed through, snaps the ledges into place where an interference of structures locks the assembly together. The compression can be achieved in a single assembly step by forcing the ring of ledges 36, facilitated by a chamfering of the edges, into the space of the annular aperture 23. During assembly, an insert key 27 is guided to a selected slot 37 to rotationally fix the end-cap insert 31 to the end cap 21.

An alternate embodiment of the means for covering 60 is shown in FIGS. 6 and 8-11, where primed (') reference characters indicate identical features with the preferred embodiment. The alternate embodiment of the means for covering 60 comprises a plug 63. The plug 63 is slidably and rotatably inter-positioned in the dispensing aperture 38'. The plug 63 slides from a closed position 65, where it seals the dispensing aperture 38', to an open position 64, where it gives access to dispense moisturized sheets 4. Both open and closed positions are marked by stops where structural interference occurs.

Figure 6:
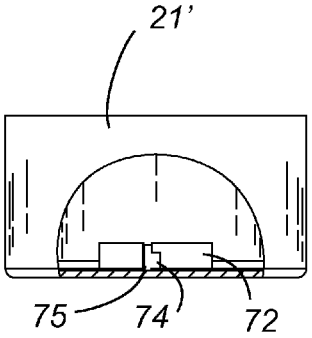
FIG. 6 is a cut-away plan view of an end cap component showing internal structure.

In a particular alternate embodiment, the plug 63 is comprised of a means for extracting 70 the next sheet 53. The means for extracting 70 is comprised of at least two resilient arms 71. The resilient arms 71 extend parallel to the axis 11' from the plug 63 to encircle the leading end of the next sheet 53 at the closed position 65. The extension of resilient arms 71 is equivalent to the distance of a preferred extraction stroke 76. The resilient arms 71 are arrayed in opposition to close upon and grab the next sheet 53 when forced together by cam followers 73 positioned at the free ends of resilient arms 71. The cam followers 73 extend radially outward from the resilient arms 71 to slidingly interact with a cam structure 72 (FIG. 6). The cam structure 72 is formed integrally with the end cap 21' and provides a path for the cam followers 73 to cause the next sheet 53 to be dragged into exposure by the extraction stoke 76. As the cam followers 73 reach spring-back gaps 74 along the path, the resilient arms 71 spring open to release the then exposed sheet 52. The extraction stoke 76 is stopped at the open position by abutment of the cam followers 73 against a facing wall of the end cap 21'. The plug 63 can then be rotated to orient the cam followers 73 to retraction channels 75. The retraction channels 75 provide retraction pathways through the cam structure 72 for the cam followers 73 to return to the closed position 65. The return stroke of the cam followers 73 bypasses the then next sheet 53 in parallelism and avoids dislodging it from position in the throat of the dispensing aperture 38'. A reverse rotation of plug the 63 resets the mechanisms and sealingly locks the closed position 65.

Figure 12:
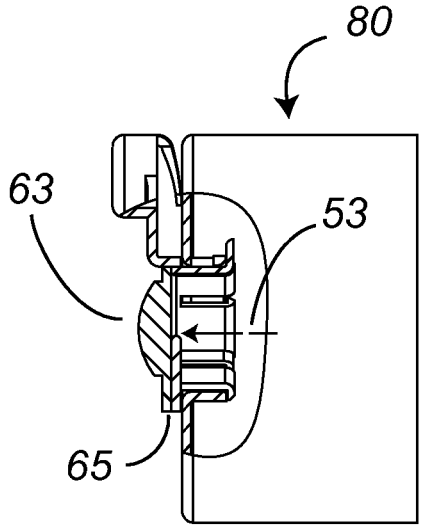
FIG. 12 is a cut-away elevation view of an end cap assembly of the alternative embodiment showing step 1 of extraction.
Figure 12A:
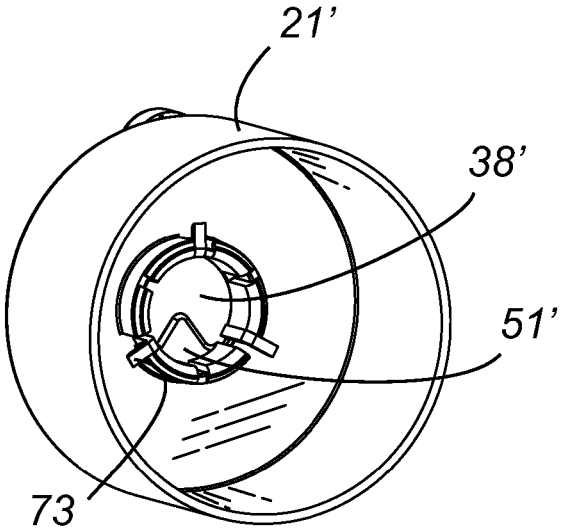
FIG. 12A is an inside perspective view corresponding to FIG. 12.
Figure 13:
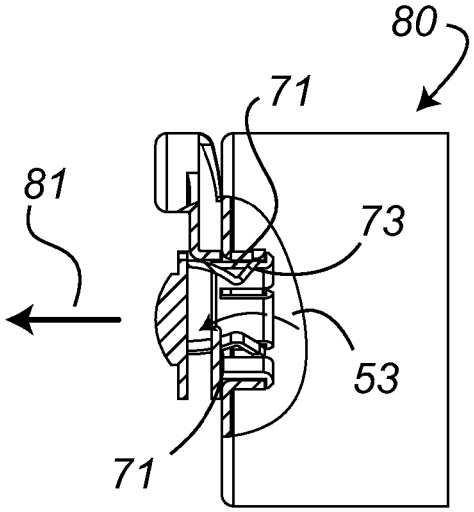
FIG. 13 is a cut-away elevation view of an end cap assembly of the alternative embodiment showing step 2 of extraction.
Figure 13A:
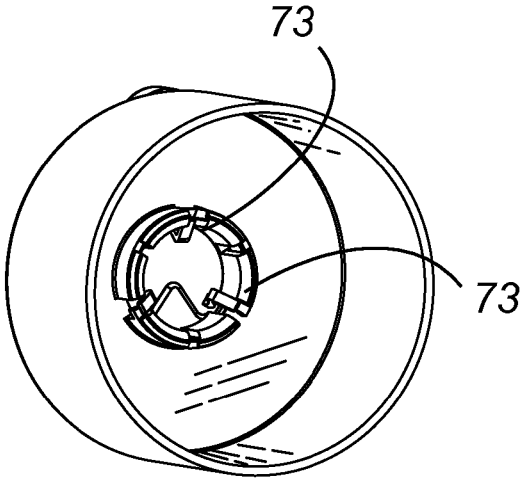
FIG. 13A is an inside perspective view corresponding to FIG. 13.
Figure 14:
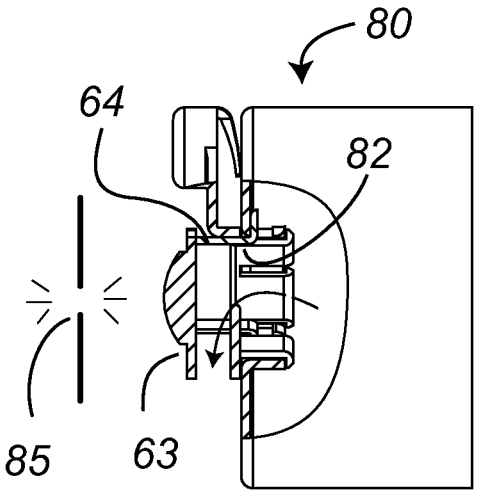
FIG. 14 is a cut-away elevation view of an end cap assembly of the alternative embodiment showing step 3 of extraction.
Figure 14A:
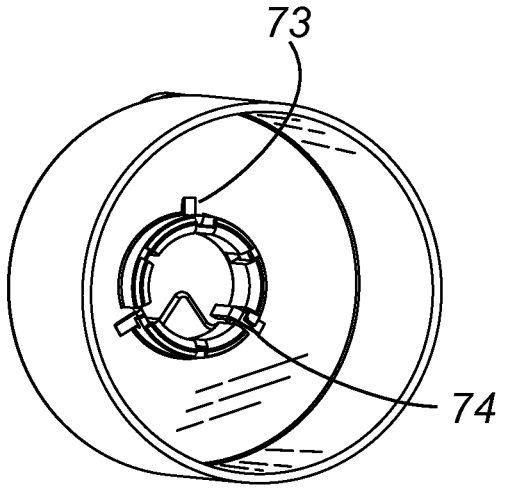
FIG. 14A is an inside perspective view corresponding to FIG. 14.
Figure 15:
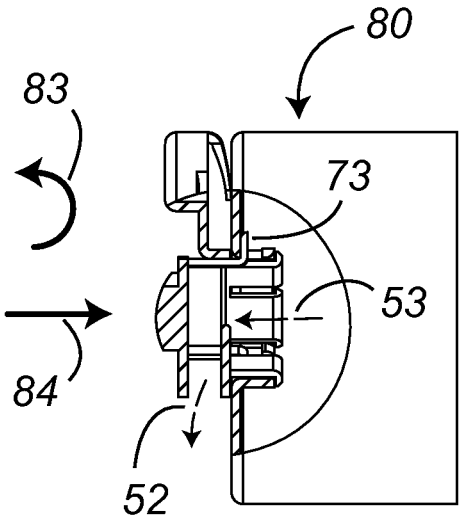
FIG. 15 is a cut-away elevation view of an end cap assembly of the alternative embodiment showing step 4 of extraction.
Figure 15A:
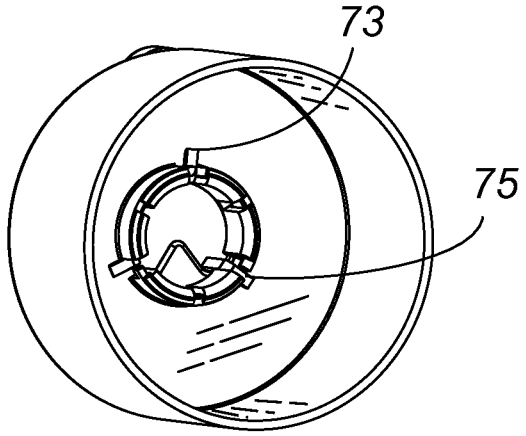
FIG. 15A is an inside perspective view corresponding to FIG. 15.

A sequence of extraction actions 80, corresponding to the foregoing recitation of structure, is illustrated in FIGS. 12-15, where cut-away portions of the end cap 21 sub-assemblies are shown. FIGS. 12A-15A are corresponding perspective views from the inside of the sub-assemblies. FIGS. 12 and 12A show the closed position 65 where the next sheet 53 is in position in the aperture 38'. FIGS. 13 and 13A show a pull stroke 81 where the resilient arms 71 are bent inwardly by the cam followers 73 to grip the next sheet 53 and drag it forward. FIGS. 14 and 14A show a release action 82 at the open position 64 where the cam followers 73 are aligned with the spring-back gaps 74; and where the exposed sheet 52 is accessible for a tear-off 85. FIGS. 15 and 15A show a rotation 83 of the plug 63 and a push stoke 84, wherein the cam followers 73, in alignment with the retraction channels 75, are returned to the closed position 65.

Figure 16:
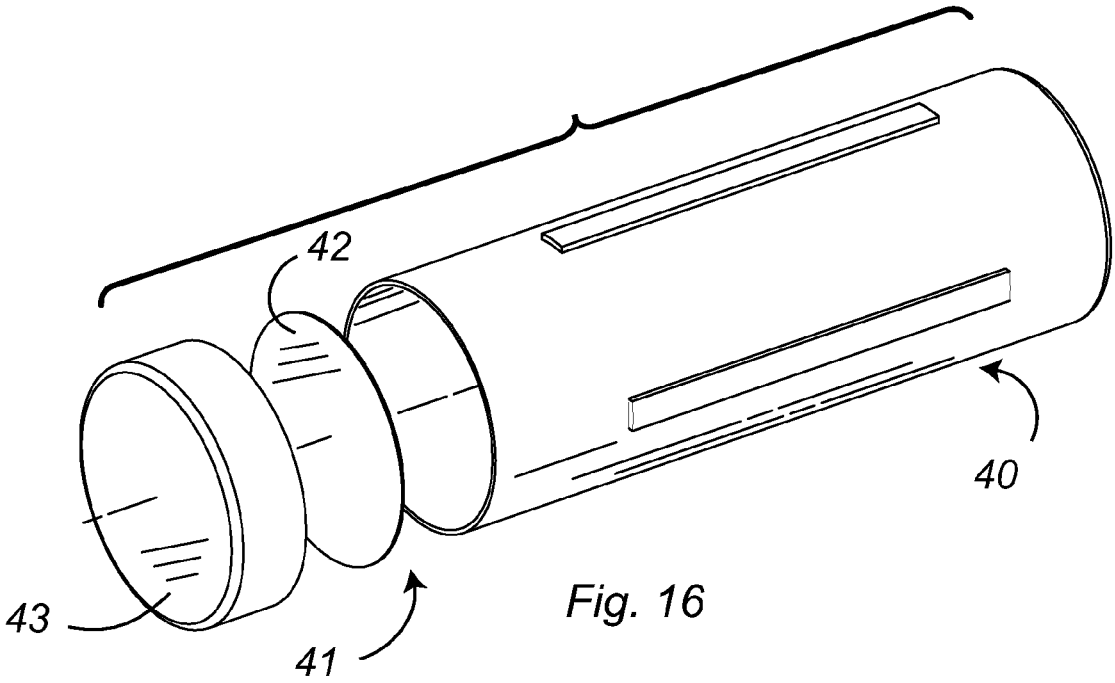
FIG. 16 is an exploded perspective view of a refill assembly.

A refill unit 40 is shown in FIG. 16. The refill unit 40 is comprised of the cylindrical dispenser 10 and a means for hermetically sealing 41. The means for hermetically sealing 41 is preferably a foil membrane 42. The foil membrane 42 is bonded to the open end 12 by heat sealing, or other means common in the art. The foil membrane 42 may be frangible, or otherwise strippable, to facilitate its removal from the open end. A disposable cap 43 is required to protect the frangible membrane from an inadvertent puncture.

Referring to back to FIGS. 4 and 7, a means for unwinding 90 is provided to facilitate the unwinding of the toilet roll 2 while avoiding a synergistic rotation of the cylindrical dispenser 10. Rotation of the cylindrical dispenser about axis 11 might twist the web of moisturized sheets 4 into an entangling conformation, or might dislodge the next sheet 53 from the dispensing aperture 38. In the preferred embodiment, the means for unwinding 90 is comprised of bearing rings 91 (FIG. 7), which are constrained to rotate in races 92 (FIG. 4). The races 92 are formed by a gap between the end caps 21 and at least two spacer bars 14 on the peripheral surface of the cylindrical dispenser 10. The inside diameter of the bearing ring 91 is sized to freely circumscribe the cylindrical dispenser 10 at the gap, and the outside diameter is sized to form a close fit with the core 3 of the toilet roll 2 while providing a marginal clearance thereto for the cylindrical dispenser 10. The toilet roll 2 spins the bearing rings 91 while the cylindrical dispenser 10 is rotationally locked about the rotation axis 11 by the insert key 27. If the spin is sufficiently frictionless, any rotation about the offset boss axis, which might cause an interference with the wall bracket 5 in the case of a clockwise unwind, is thereby minimized.

All of the constituent components of the toilet roll dispenser 1, except for the moisturized sheets 4 and the foil membrane 42, are preferably injection molded. The thermoplastic resins of choice will have the properties of toughness, stiffness and low moisture permeability. The molded parts may be translucent, transparent or opaque. The wall thicknesses of the container should be sufficient to prevent critical moisture loss over the period of the preferred shelf life. The preferred resins are commodity-grade polyethylene, polypropylene, high-impact polystyrene, or polyolefin. The snap-fit cap 61 may be molded together with the end cap 21 in a living hinge construction.

The assembly of the toilet roll dispenser 1, in a successive use scenario, involves removal of the disposable cap 43 from the refill unit 40, removal of the foil membrane 42, placement of the bearing rings 91 over each end of the cylindrical dispenser 10, and placement of the end cap 21 subassemblies over each end. In placing the subassembly over the open end 12, however, the leading end of the moisturized sheets 4 must be threaded through the dispensing aperture 38. Also, care must be taken to force the open end 12 into the luer taper 101. The end cap 21 subassemblies are assumed to have been pre-assemblies of the insert component 31, the snap-fit cap 61 and the end cap 21, in the case of the preferred embodiment, and the insert component 31', the plug 63 and the end cap 21', in the case of the alternate embodiment.

It is to be understood that the invention is not limited in its application to the details of construction and to the arrangements of the components set forth in the preceding description or illustrated in the drawings. For example, the closed end 13 of the cylindrical dispenser 10 may be comprised of the foil membrane 42. Also, it is to be understood that the phraseology and terminology employed herein are for the purpose of the description and should not be regarded as limiting.

What is claimed is:

1. A toilet roll dispenser for moisturized sheets, comprising:

a cylindrical dispenser, having a rotational axis and two ends, configured to fit within the core of a toilet roll;

a plurality of moisturized sheets contained within the cylindrical dispenser, said moisturized sheets connected by perforations to dispense sequentially from, at least, one end of the core;

a means for singlating individual sheets by initiating a tear at a perforation;

a means for connecting the cylindrical dispenser to a wall bracket, said wall bracket having two arms with recesses to receive a conventional toilet roll spool; and at least two bearing rings supporting the toilet roll and rotating freely in corresponding circumscribing races near the ends of the cylinder, the rings configured to frictionally fit the core of the toilet roll and provide clearance for the cylinder;

whereas, a roll of toilet paper rotatably mounted on the cylindrical dispenser and suspended from the wall bracket by the means for connecting unwinds conventionally about the rotational axis without causing rotation of the cylinder, while the moisturized sheets dispense from the interior of the core.

2. The toilet roll dispenser of claim 1, wherein the means for connecting comprises end caps placed at each end of the cylindrical dispenser, the end caps having bosses configured to fit the recesses and a means for articulating the bosses to removably and securely mount the cylindrical dispenser between the two arms of the wall bracket.

3. The toilet roll dispenser of the claim 1, wherein the cylindrical dispenser comprises a hermetically-sealed refill unit having moisture vapor barrier protection.

4. The toilet roll dispenser of claim 2, wherein at least one of the end caps comprises a dispensing aperture centered on the rotational axis in communication with the interior of the cylindrical dispenser.

5. The toilet roll dispenser of claim 4, further comprising a means for covering the dispensing aperture to prevent moisture loss from the interior of the cylindrical dispenser.

6. The toilet roll dispenser of claim 4, wherein the bosses lie along an axis parallel to and offset from the rotational axis such that the dispensing aperture can be made accessible from below the wall bracket.

7. The toilet roll dispenser of claim 6, wherein the means for articulating each boss comprises a flexible beam with the boss positioned at a distal end thereof, a proximal end thereof based at the end cap, the beam positioning the boss to articulate into the recess by flexing the distal end.

8. The toilet roll dispenser of claim 5, wherein the means for singlating comprises a horn positioned in the aperture, the position such that a downward pull on an exposed sheet effectively forces the horn into the sheet and snags an elongated slit in the perforation, the snag initiating a tear which leaves a next sheet flush with the aperture and the exposed sheet parted from it at the perforation.

9. The toilet roll dispenser of claim 8, wherein the means for covering the dispensing aperture is a snap-fit cap.

10. The toilet roll dispenser of claim 8, wherein the means for covering the dispensing aperture is a plug which slides into the aperture to define a closed position at a stop and out of the aperture to define an open position at a stop, the closed position sealing the aperture, the open position giving access to an exposed end of the next sheet, the movement there between drawing out the next sheet by a means for extracting.

11. The toilet roll dispenser of claim 10, wherein the means for extracting is at least two resilient arms extending inwardly from the plug, the resilient arms brought together dynamically by a camming action to grip the end of the next sheet while moving from the closed position to the open position, the arms releasing the grip at the open stop.

12. The toilet roll dispenser of claim 3, wherein the refill unit is comprised of a closed end at one end of the cylindrical dispenser, an open end at the other end of the cylindrical dispenser, and a means for hermetically sealing the open end.

13. The toilet roll dispenser of claim 12, wherein the means for hermetically sealing comprises a bonded foil membrane.

14. The toilet roll dispenser of claim 13, wherein the means for hermetically sealing further comprises a disposable cap to protect the foil membrane from being inadvertently punctured.

15. A toilet roll dispenser for moisturized sheets, comprising:

a cylindrical dispenser, having a rotational axis and two ends, configured to fit within the core of a toilet roll;

a plurality of moisturized sheets contained within the cylindrical dispenser, said moisturized sheets connected by perforations to dispense sequentially from, at least, one end of the core through an aperture;

a means for singlating individual sheets by initiating a tear at a perforation;

a means for preventing moisture loss from the cylindrical dispenser;

a means for connecting the cylindrical dispenser to a wall bracket, said wall bracket having two arms with recesses to receive a conventional toilet roll spool; and at least two bearing rings rotating freely in corresponding circumscribing races near the ends of the cylinder, the rings configured to frictionally fit the core of the toilet roll and provide clearance for the cylinder, the rings providing a rotatable mounting for the toilet roll;

whereas, a roll of toilet paper suspended from the wall bracket by the means for connecting unwinds conventionally about the rotational axis, while the moisturized sheets dispense from the interior of the core.

16. The toilet roll dispenser of claim 15, wherein the means for preventing moisture loss comprises a closed end and an open end to the cylindrical dispenser, the open end sealingly fitted to an end cap by a luer taper.

17. The toilet roll dispenser of claim 16, wherein the means for preventing moisture loss further comprises a removable closure for the aperture.

* * * * *